United States Patent [19]

Becker et al.

[11] 4,390,308

[45] Jun. 28, 1983

[54] ADVANCE MECHANISM FOR A MINE ROOF SUPPORT ASSEMBLY

[75] Inventors: Kunibert Becker, Werl; Rüdiger Kirchbrücher, Dortmund-Brackel; Günter Lagodka; Klaus-Dieter Pohlmann, both of Lunen, all of Fed. Rep. of Germany

[73] Assignee: Gewerkschaft Eisenhutte Westfalia, Lunen, Fed. Rep. of Germany

[21] Appl. No.: 300,826

[22] Filed: Sep. 10, 1981

[30] Foreign Application Priority Data

Sep. 13, 1980 [DE] Fed. Rep. of Germany ..... 3034645

[51] Int. Cl.[3] ..... E21D 23/00

[52] U.S. Cl. ..... 405/299; 405/291; 405/295

[58] Field of Search ..... 405/299, 291, 292, 293, 405/294, 295, 296, 297, 298

[56] References Cited

U.S. PATENT DOCUMENTS

| | | | |
|---|---|---|---|
| 3,482,878 | 12/1969 | Floter | 405/299 |
| 4,184,791 | 1/1980 | Becker et al. | 405/291 |
| 4,187,042 | 2/1980 | Plevak et al. | 405/291 |
| 4,227,833 | 10/1980 | Plester et al. | 405/299 |

FOREIGN PATENT DOCUMENTS

| | | | |
|---|---|---|---|
| 1171945 | 11/1969 | United Kingdom | 405/299 |

*Primary Examiner*—Dennis L. Taylor
*Assistant Examiner*—John A. Gungor
*Attorney, Agent, or Firm*—Sughrue, Mion, Zinn, Macpeak and Seas

[57] ABSTRACT

A roof support assembly is constituted by a plurality of roof support units and a plurality of advance mechanisms. The units are positioned side-by-side along a longwall face of a mineral mining working. Each advance mechanism comprises a pair of generally parallel hydraulic advance rams and a guide rod system constituted by a pair of resilient generally parallel guide rods. Each guide rod system is attached, at one end, to a conveyor extending along the longwall face. The other end of each guide rod of each advance mechanism is attached to a respective slide piece which is slidably guided on a respective guide rail which is attached to a respective floor girder of a roof support unit. The slide pieces are attached to the piston rods of the hydraulic advance rams. The cylinders of the hydraulic advance rams are attached to one of the adjacent floor girders, and the slide piece attached to the piston rod of hydraulic advance ram is attached to the guide rod system. The slide piece attached to the piston rod of the hydraulic advance ram is attached to the other floor girder.

22 Claims, 7 Drawing Figures

ADVANCE MECHANISM FOR A MINE ROOF SUPPORT ASSEMBLY

BACKGROUND OF THE INVENTION

This invention relates to an advance mechanism for a mine roof support assembly.

A known type of mine roof support assembly is constituted by a plurality of roof support units positioned side-by-side along, for example, a longwall face. Each of the units has a roof bar supported on a floor sill by means of hydraulic props. The floor sill may be constituted by a pair of spaced-apart floor girders. In order to advance the assembly to follow the advance of the longwall face, the roof support units are advanced, individually or in groups, by means of hydraulic advance rams. During the advance of any given unit, its hydraulic props are relaxed so that its roof bar is not under load.

A known type of advance mechanism comprises a pair of hydraulic advance rams and a pair of resilient, generally parallel guide rods. The guide rods are interconnected at one end by means of a head-piece which is attachable to a conveyor extending along a longwall face. The other ends of the guide rods are attached to a floor girder of a roof support unit. The hydraulic advance rams are pivotally connected to the guide rods and act on said floor girders (See DE-OS No. 2 758 663)

This type of advance mechanism enables the roof support units to be aligned accurately during their advance movements, whilst the resilience of the guide rods permits the floor girders of the units to adapt to irregularities in the floor of the mine working. Such an advance mechanism can be positioned between an adjacent pair of roof support units, the guide rails of that advance mechanism being fastened to the adjacent floor girders of that pair of roof support units. In this case, the advance mechanism is called an external advance mechanism. Alternatively, each roof support has two floor girders, and a respective advance mechanism is provided for each roof support unit, the guide rails of each advance mechanism being fastened to the mutually-facing sides of the floor girders of the associated roof support unit. In this case, the advance mechanism is called an internal advance mechanism. In either case, the advance mechanisms of a roof support assembly, are used to advance the conveyor (or other longwall installation) in steps to follow up the advance of the working face as it is won. The advance mechanisms are then used to advance the roof support units in one follow-up step. This follow-up advance of the roof support units can be accomplished in two ways. Thus, the conveyor (or other longwall installation) can be used as an abutment for the follow-up step. Alternatively, the roof support units can be advanced individually, with the stationary roof support units providing an abutment for the follow-up movement. In this case, the advance of the roof support units is said to be independent of the conveyor (or other longwall installation).

This known type of advance mechanism has, however, a number of disadvantages. In particular, because of the arrangement of its hydraulic advance rams, when the roof support units are being advanced, only one ram of each advance mechanism is effective. This means that one of the roof support units associated with each advance mechanism must be advanced by the retraction of one of the hydraulic rams of that advance mechanism. This is disadvantageous because, during retraction, the annular working chamber of a ram is pressurized, and the area of this chamber is obviously smaller than that of the other (cylindrical) working chamber of that ram. Consequently, the advance force applied by this ram is relatively small, and this is disadvantageous in that this relatively small force must be used to advance the associated roof support unit which is very heavy. Moreover, the guide rods of the advance mechanisms are used for transmitting the forces used for advancing. Consequently, during advance movements, oppositely-directed forces are simultaneously applied to the guide rods. The resulting bending moments (and rotational moments) which are applied to the guide rods make it difficult to guide the roof support units accurately during their advance movements.

The aim of the invention is to provide an advance mechanism for a mine roof support assembly which does not suffer from the disadvantages of the known type of advance mechanism.

SUMMARY OF THE INVENTION

The present invention provides an advance mechanism for a roof support assembly constituted by a plurality of roof support units positioned side-by-side along, for example, a longwall face of a mineral mining working, the advance mechanism comprising a pair of generally parallel hydraulic advance rams and a guide rod system constituted by a pair of resilient, generally parallel guide rods, the guide rod system being attachable, at one end, to a conveyor extending along the longwall face, the other end of each guide rod being attached to a respective slide piece which is slidably guided on a respective guide rail which is attachable to a respective floor girder of a roof support unit, the slide pieces being attached to the piston rods of the hydraulic advance rams, wherein the cylinders of the hydraulic advance rams are attachable to one of the adjacent floor girders, and the slide piece attached to the piston rod of one of the hydraulic advance rams is attached to the guide rod system. Preferably, the slide piece attached to the piston rod of the other hydraulic advance ram is attachable to the other floor girder.

This advance mechanism is such that, during roof support unit advance which is independent of the conveyor, the advance forces are transmitted directly to the roof support units. The guide rod system is, therefore, unaffected by the bending moments or rotational moments.

Advantageously, the slide piece attached to the piston rod of the other hydraulic advance ram is releasably attachable to the other floor girder. Preferably, the slide piece attached to the piston rod of the other hydraulic advance ram is provided with a dog which extends towards the other floor girder, the guide rail associated with the other floor girder passing through an aperture in the dog, and a cotter pin being provided for releasably attaching the dog to said guide rail. The interaction between the dog and the guide rail associated with the other floor girder is effective to maintain a predetermined distance between the floor girders. In practice, small changes in the distance between the floor girders can occur, but these are so small that they can be ignored. When this advance mechanism is used as an external advance mechanism, said one hydraulic advance ram can be retracted to advance the guide rod system (and hence an associated conveyor section), and then extended to advance one of the associated roof support units in a follow-up movement; and the other hydraulic advance ram is retracted to advance the other associated roof support unit. In this case, said one hydraulic advance ram uses its cylindrical working chamber for applying the force for advancing the associated roof support unit, the annular working chamber being used for advancing the guide rod system. Thus, the larger working chamber of this ram is used for advancing the heavier load (the associated roof support unit). Unfortunately, the annular working chamber of the other hydraulic advance ram must then be used to advance its associated roof support unit.

In order that the other hydraulic advance ram can apply a sufficiently large force to advance its associated roof support unit, its piston rod may have a smaller diameter than the piston rod of said one hydraulic advance ram. This results in the cross-sectional area of the annular working chamber of the other hydraulic advance being increased, which leads to an increased force for advancing the associated roof support unit. As this piston rod is subjected only to tension forces, this reduction in diameter is possible. Preferably, the cross-sectional area of the annular working chamber of the other hydraulic advance ram is substantially equal to the cross-sectional area of the cylindrical working chamber of said one hydraulic advance ram. This ensures that both the roof support units are advanced by substantially equal forces.

Advantageously, means are provided for hydraulically locking the other hydraulic advance ram. In this arrangement, said one hydraulic advance ram is retracted to advance the guide rod system (plus conveyor), and then extended to advance both of the adjacent floor girders. The other hydraulic advance ram serves merely to lock the two floor girders together. Here again, therefore, the cylindrical working chamber of said one hydraulic advance ram is used to advance the floor girders. This arrangement is particularly useful where the advance mechanism is an internal advance mechanism. Moreover, this means that the same basic advance mechanism can be used as an external advance mechanism or an internal advance mechanism with the minimum of modification.

Each of the guide rails may be constituted by a cylindrical rod. This arrangement permits the slide pieces (and the dog) to pivot about the longitudinal axes of the guide rails, so that the associated floor girders can adapt themselves to irregularities or inclinations in the floor of the working.

The invention also provides a roof support assembly for use in a longwall face of a mineral mining working, the roof support assembly being constituted by a plurality of roof support units positioned side-by-side, and means for advancing the roof support units towards the longwall face, each of the roof support units having at least one floor girder, the advance means being constituted by a plurality of advance mechanisms each as defined above, the guide rails of the advance mechanisms being attached to respective floor girders of the roof support units.

Advantageously, each advance mechanism is positioned between an adjacent pair of roof support units, the guide rails of that advance mechanism being fastened to the adjacent floor girders of that pair of roof support units.

In one preferred embodiment, the cylinders of the hydraulic advance rams of each advance mechanism are attached to the associated one floor girder by means of an arm extending laterally with respect to said one floor girder. This results in a symmetrical and space-saving arrangement.

Alternatively, the cylinders of the hydraulic advance rams of each advance mechanism are attached to both of the adjacent floor girders, the attachment between each of the dogs and its associated guide rail is released, and each of the slide pieces attached to the piston rod of the associated other hydraulic advance ram is attached to the associated guide rod system. In this case, the cylinders of the hyraulic advance rams of each advance mechanism may be attached to the adjacent floor girders by means of a cross-bar extending laterally between said floor girders. In this arrangement, the two floor girders associated with each advance mechanism are secured together by the cross-bar, and the piston rod of the other hydraulic advance ram is attached to the guide rod system, so that both rams can be used for advancing the two floor girders. Thus, double the advance force is available for advancing the heavy roof support units. This arrangement is also particularly useful as an internal advance mechanism.

BRIEF DESCRIPTION OF DRAWINGS

A mine roof support assembly incorporating advance mechanisms constructed in accordance with the invention will now be described, by way of example, with reference to the accompanying drawings, in which.

DESCRIPTION OF PREFERRED EMBODIMENTS

Figure 1:
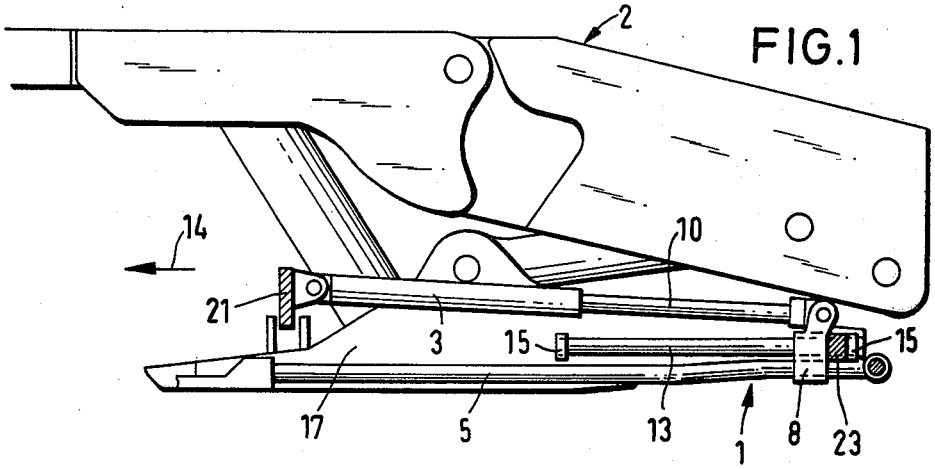
FIG. 1 is a part-sectional side elevation of one roof support unit of the assembly, and shows part of an associated advance mechanism.
Figure 5:
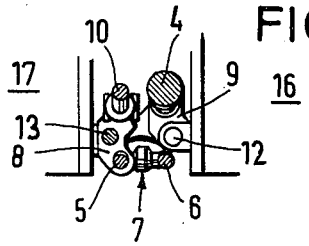
FIG. 5 is a cross-section taken on the line V—V of FIG. 2.

Referring to the drawings, FIG. 1 shows part of one advance mechanism (indicated generally by the reference numeral 1) and one roof support unit (indicated generally by the reference numeral 2) of a longwall mine roof support assembly. The assembly is constituted by a plurality of roof support units 2 positioned side-by-side along the goaf side of a longwall conveyor (not shown). A respective advance mechanism 1 is positioned between each pair of adjacent roof support units 2. Each roof support unit 2 has a pair of floor girders 16 and 17.

Each advance mechanism 1 has a pair of hydraulic advance rams 3 and 4 (see FIGS. 2 to 4), and a pair of resilient guide rods 5 and 6, the guide rods constituting a guide rod system 7. The front (face side) ends of the guide rods 5 and 6 are attached to a channel section (not shown) of the longwall conveyor. Each advance mechanism 1 also includes a pair of slide pieces 8 and 9. The slide piece 8 is attached to the guide rod 5 and to the face end of the piston rod 10 of the advance ram 3. The slide piece 9 is attached to the free end of the piston rod 11 of the advance ram 4. The slide pieces 8 and 9 are slidably guided on respective cylindrical guide rails 13 and 12 which are attached to the mutually-facing sides of the adjacent floor girders 17 and 16 respectively by means of brackets 15.

The cylinders of the two advance rams 3 and 4 of each advance mechanism 1 are pivotablly attached to a common link 18, and the piston rods 10 and 11 are pivotally attached to their respective slide pieces 8 and 9 by respective links 19. The link 18 of each advance mechanism 1 is provided with a laterally-extending arm 21, the arm 21 being rigidly mounted in a bearing block 22 attached to the adjacent floor girder 16.

The slide piece 9 of each advance mechanism 1 is provided with a laterally-extending dog 23. This dog 23 is formed with a cylindrical aperture which is a sliding fit around the associated guide rail 13. A cotter pin 24 (shown only schematically in the drawings) is provided for releasably locking the dog 23 to the guide rail 13. Thus, the dog 23 can easily and rapidly be secured to the guide rail 13 so that relative longitudinal movement therebetween is prevented, or it can be released for relative sliding movement.

The mode of operation of one of the advance mechanisms 1 will now be described with reference to FIGS. 2 to 4. In this mode of operation, the roof support units 2 are advanced independently of the conveyor; that is to say the roof support units are advanced in turn, the stationary units providing an abutment for each advancing unit.

Figure 2:
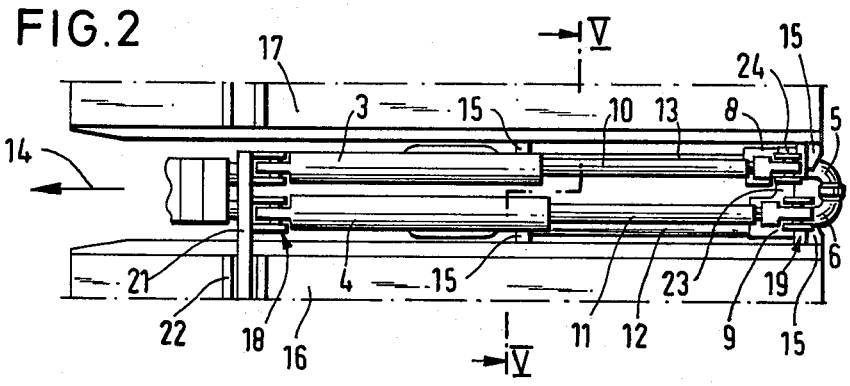
FIG. 2 is a plan view of one advance mechanism positioned between the adjacent floor girders of a pair of adjacent roof support units.

FIG. 2 shows the advance mechanism 1 in the position in which the adjacent roof support units 2 have just been advanced. In this position, both the hydraulic rams 3 and 4 are extended. The hydraulic ram 3 is then retracted, in steps, so that its position rod 10 advances the guide rod system 7 in the direction 14 of advance. This causes the associated conveyor channel section to be advanced in steps. Each advance step is arranged to correspond to the cutting depth of a mineral winning machine (not shown) which is moveable to and fro along the face side of the conveyor. During each such advance step, the slide piece 8 slides on the guide rail 13.

Figure 3:
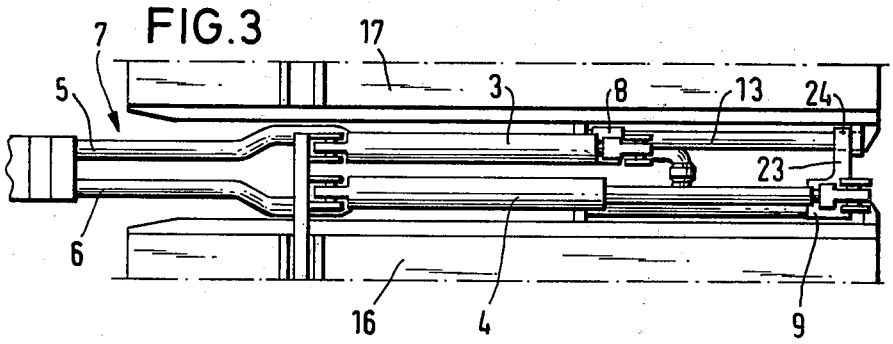
FIG. 3 is a plan view similar to that of FIG. 2, but showing a different operating position.

FIG. 3 shows the advance mechanism 1 in the position in which the associated conveyor channel section has been fully advanced. Thereafter, the floor girder 17 (together with its roof support unit 2—the upper roof support unit as seen in FIGS. 2 to 4) is advanced, in one follow-up movement, by retracting the hydraulic ram 4. As the ram 4 is retracted, the slide piece 9 is advanced along the guide rail 12, and the floor girder 17 moves with it since the cotter pin 24 is positioned to lock the dog 23 to the guide rail 13.

Figure 4:
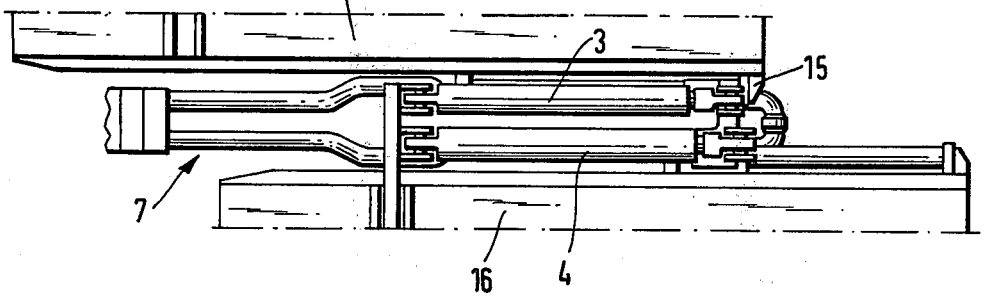
FIG. 4 is a plan view similar to those of FIGS. 2 and 3, but showing another operating position.

FIG. 4 shows the advance mechanism 1 in the position in which the floor girder 17 and has been fully advanced. Thereafter, the floor girder 16 (together with its roof support unit 2—the lower roof support unit as seen in FIGS. 2 to 4) is advanced, in one follow-up movement, by extending the hydraulic ram 3. During this movement, the piston rod 10 of the ram 3 is prevented from moving because it abuts the bracket 15 fixed to the floor girder 17 of the advanced, upper roof support unit 2 (whose props are extended so as to anchor that unit firmly between the roof and the floor of the longwall working). Consequently, the cylinder of the ram 3 moves in the direction 14 of advance, carrying the floor girder 16 (and hence the lower roof support unit) with it owing to the positive interconnection of the arm 21 within the bearing block 22. This advance movement can be assisted by simultaneously retracting the hydraulic ram 4. Alternatively, the ram 4 can be switched to a "floating" condition so that its piston rod 11 can be retracted in a non-pressurized manner.

Figure 6:
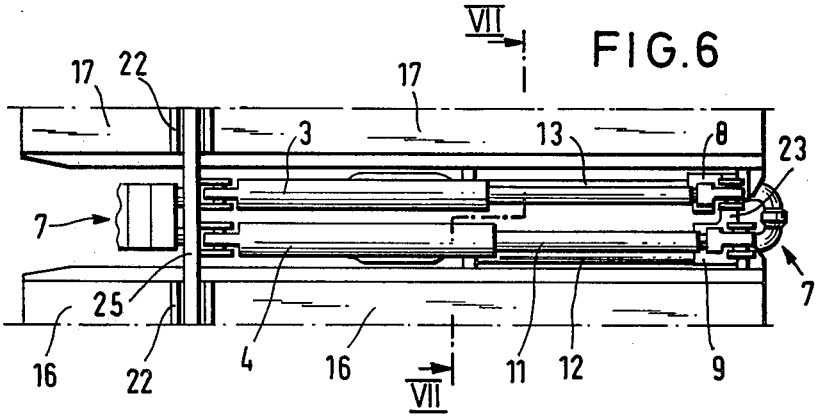
FIG. 6 is a plan view similar to that of FIG. 2, but showing a modified arrangement.
Figure 7:
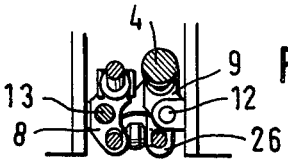
FIG. 7 is a cross-section taken on the line VII—VII of FIG. 6.

FIGS. 6 and 7 show a modified form of advance mechanism 1. This modified advance mechanism 1 is intended for use in advancing roof support units 2 in dependence upon the conveyor, that is to say where the conveyor constitutes the abutment for the roof support unit advance movement. In this arrangement, the arm 21 of the advance mechanism is replaced by a cross-bar 25, the cross bar being rigidly mounted to bearing blocks 22 attached to the adjacent floor girders 16 and 17. Consequently, the floor girders 16 and 17 cannot move relative to one another in the advance direction. Moreover, in this arrangement, the positive connection between the dog 23 and the guide rail 13 is not required, so the cotter pin 24 is removed. Instead, the slide piece 9 is attached to the guide rod 6 by means of an attachment 26 (see FIG. 7). The attachment 26 can easily and rapidly be secured to the guide rod 6 by means of, for example, a cotter pin (not shown). When this cotter pin is in position, the slide piece 9 and the guide rod 6 are secured together so as to prevent relative longitudinal movement therebetween. Thus, in this arrangement, the two rams 3 and 4 are extended and retracted simultaneously, so that additional advance forces are available both for conveyor advance and roof support unit advance.

In order to advance the associated conveyor channel section (not shown), the two rams 3 and 4 are retracted simultaneously. As with the embodiment of FIGS. 1 to 5, this advance movement is carried out in steps. Similarly, in order to advance the associated roof support units, the rams 3 and 4 are simultaneously extended. During both extension and retraction of the rams 3 and 4, the slide pieces 8 and 9 slide on their respective guide rails 13 and 12. The distance between the floor girders 16 and 17 is maintained during their advance movement owing to the sliding connection between the slide piece 9 and the two guide rails 12 and 13.

It will be apparent that the modified advance mechanism of FIGS. 6 and 7 could be used as an internal advance mechanism. It would also be possible to use advance mechanism of FIGS. 1 to 5 as an internal advance mechanism if the associated roof support units were of two-part contraction.

Each of the advance mechanisms described above is such that the diameter of its ram 4 is somewhat greater than that of its ram 3. Thus, during independent advance of the floor girder 17 (during which the annular working chamber of the ram 4 is pressurized), the advance force available is substantially equal to that provided during the advance of the floor girder 16 (during which the cylindrical working chamber of the ram 3 is pressurized). Alternatively, the diameters of the rams 3 and 4 may be the same, in which case the piston rod of the ram 4 would have a smaller diameter than the piston rod of the ram 3. Here again, therefore, the ram 4 would have a relatively large annular working chamber, and hence retraction of the ram 4 would produce a relatively large advance force for advancing the floor girder 17.

It will be apparent that the advance mechanisms described above could be modified in a number of ways. For example, the advance mechanism of FIGS. 1 to 5 could be modified by providing the ram 4 with a hydraulic locking device. In this case, the ram 3 would be retracted to advance the guide rod system 5 (plus the conveyor), and then extended to advance both floor girders 16 and 17 simultaneously; the ram 4 merely serving to lock the two floor girders together. This arrangement would, therefore, be useful as an internal advance mechanism. The guide rail 13 of each advance mechanism may be provided with a longitudinally-extending groove, the associated cotter pin 24 being engageable in this groove.

We claim:

1. An advance mechanism for a roof support assembly comprising a plurality of roof support units positioned side-by-side along, for example, a longwall face of a mineral mining working, the advance mechanism comprising a pair of generally parallel hydraulic advance rams and a guide rod system including a pair of resilient, generally parallel guide rods, the guide rod system being attached, at one end, to a conveyor extending along the longwall face, the other end of each guide rod being attached to a respective slide piece which is slidably guided on a respective guide rail which is attached to a respective floor girder of a roof support unit, the slide pieces being attached to the piston rods of the hydraulic advance rams, wherein the cylinders of the hydraulic advance rams are attached to one of the adjacent floor girders, and the slide piece attached to the piston rod of one of the hydraulic advance rams is attached to the guide rod system.

2. An advance mechanism according to claim 1, wherein the slide piece attached to the piston rod of the other hydraulic advance ram is attached to the other floor girder.

3. An advance mechanism according to claim 2, wherein the slide piece attached to the piston rod of the other hydraulic advance ram is releasably attached to the other floor girder.

4. An advance mechanism according to claim 3, wherein the slide piece attached to the piston rod of the other hydraulic advance ram is provided with a dog which extends towards the other floor girder, the guide rail associated with the other floor girder passing through an aperture in the dog, and a cotter pin being provided for releasably attaching the dog to said guide rail.

5. An advance mechanism according to claim 1, wherein the piston rod of the other hydraulic advance ram has a smaller diameter than the piston rod of said one hydraulic advance ram.

6. An advance mechanism according to claim 1, wherein the cross-sectional area of the annular working chamber of the other hydraulic advance ram is substantially equal to the cross-sectional area of the cylindrical working chamber of said one hydraulic advance ram.

7. An advance mechanism according to claim 1, wherein means are provided for hydraulically locking the other hydraulic advance ram.

8. An advance mechanism according to claim 1, wherein each of the guide rails is a cylindrical rod.

9. An advance mechanism according to claim 4, wherein the guide rail which is releasably attached to the dog is formed with a longitudinally-extending groove, the associated cotter pin being engageable in said groove for releasably attaching the associated slide piece to said guide rail.

10. A roof support assembly for use in a longwall face of a mineral mining working, the roof support assembly being constituted by a plurality of roof support units positioned side-by-side, and means for advancing the roof support units towards the longwall face, each of the roof support units having at least one floor girder, the advance means being constituted by a plurality of advance mechanisms, each advance mechanism comprising a pair of generally parallel hydraulic advance rams and a guide rod system including a pair of resilient, generally parallel guide rods, the guide rod system being attached, at one end, to a conveyor extending along the longwall face, the other end of each guide rod being attached to a respective slide piece which is slidably guided on a respective guide rail which is attached to a respective floor girder of a roof support unit, the slide pieces being attached to the piston rods of the hydraulic advance rams, wherein the cylinders of the hydraulic advance rams are attached to one of the adjacent floor girders, and the slide piece attached to the piston rod of one of the hydraulic advance rams is attached to the guide rod system.

11. A roof support assembly according to claim 10, wherein the slide piece of each advance mechanism attached to the piston rod of the other hydraulic advance ram of that advance mechanism is attached to the associated other floor girder.

12. A roof support assembly according to claim 11, wherein the slide piece of each advance mechanism attached to the piston rod of the other hydraulic advance of that advance mechanism is releasably attached to the associated other floor girder.

13. A roof support assembly according to claim 12, wherein the slide piece of each advance mechanism attached to the piston rod of the other hydraulic advance ram of that advance mechanism is provided with a dog which extends towards the associated other floor girder, the guide rail attached to said associated other floor girder passing through an aperture in the dog, and a cotter pin being provided for releasably attaching the dog to said guide rail.

14. A roof support assembly according to claim 10, wherein the piston rod of the other hydraulic advance ram of each advance mechanism has a smaller diameter than the piston rod of said one hydraulic advance ram of that advance mechanism.

15. A roof support assembly according to claim 10, wherein the cross-sectional area of the annular working chamber of the other hydraulic advance ram of each advance mechanism is substantially equal to the cross-sectional area of the cylindrical working chamber of said one hydraulic advance ram of that advance mechanism.

16. A roof support assembly according to claim 10, wherein means are provided for hydraulically locking the other hydraulic advance ram of each advance mechanism.

17. A roof support assembly according to claim 10, wherein each of the guide rails is a cylindrical rod.

18. A roof support assembly according to claim 13, wherein the guide rail of each advance mechanism which is releasably attached to the associated dog is formed with a longitudinally-extending groove, the associated cotter pin being engageable in said groove for releasably attaching the associated slide piece to said guide rail.

19. A roof support assembly according to claim 10, wherein each advance mechanism is positioned between an adjacent pair of roof support units, the guide rails of that advance mechanism being fastened to the adjacent floor girders of that pair of roof support units.

20. A roof support assembly according to claim 10, wherein the cylinders of the hydraulic advance rams of each advance mechanism are attached to the associated one floor girder by means of an arm extending laterally with respect to said one floor girder.

21. A roof support assembly according to claim 13, wherein the cylinders of the hydraulic advance rams of each advance mechanism are attached to both of the adjacent floor girders, the attachment between each of the dogs and its associated guide rail is released, and each of the slide pieces attached to the piston rod of the associated other hydraulic advance ram is attached to the associated guide rod system.

22. A roof support assembly according to claim 21, wherein the cylinders of the hydraulic advance rams of each advance mechanism are attached to the adjacent floor girders by means of a cross-bar extending laterally between said floor girders.

* * * * *